US010045136B2

(12) United States Patent
Clerici Beltrami et al.

(10) Patent No.: US 10,045,136 B2
(45) Date of Patent: Aug. 7, 2018

(54) MEMS LOUDSPEAKER WITH POSITION SENSOR

(71) Applicant: USound GmbH, Graz (AT)

(72) Inventors: Andrea Rusconi Clerici Beltrami, Vienna (AT); Ferruccio Bottoni, Graz (AT)

(73) Assignee: USound GmbH, Graz (AT)

( * ) Notice: Subject to any disclaimer, the term of this patent is extended or adjusted under 35 U.S.C. 154(b) by 0 days.

(21) Appl. No.: 15/235,438

(22) Filed: Aug. 12, 2016

(65) Prior Publication Data

US 2017/0064474 A1 Mar. 2, 2017

(30) Foreign Application Priority Data

Aug. 27, 2015 (DE) ..... 10 2015 114 242

(51) Int. Cl.

| | |
|---|---|
| ***H04R 29/00*** | (2006.01) |
| ***H04R 3/00*** | (2006.01) |
| ***H04R 19/00*** | (2006.01) |
| ***H04R 17/00*** | (2006.01) |

(52) U.S. Cl.

CPC ..... *H04R 29/001* (2013.01); *H04R 3/00* (2013.01); *H04R 3/002* (2013.01); *H04R 3/007* (2013.01); *H04R 17/00* (2013.01); *H04R 19/005* (2013.01); *H04R 2201/003* (2013.01)

(58) Field of Classification Search

CPC ..... H04R 29/001; H04R 3/00; H04R 3/002; H04R 3/007; H04R 17/00; H04R 19/005; H04R 2201/003

See application file for complete search history.

(56) References Cited

U.S. PATENT DOCUMENTS

| | | | | |
|---|---|---|---|---|
| 4,276,443 | A | 6/1981 | Meyers | |
| 5,588,065 | A | 12/1996 | Tanaka et al. | |
| 5,764,781 | A | 6/1998 | Ding | |
| 9,269,831 | B2 | 2/2016 | Ehrenpfordt et al. | |
| 9,648,433 | B1 * | 5/2017 | Doller | H04R 29/004 |
| 2004/0197227 | A1 | 10/2004 | Hauan et al. | |
| 2005/0130360 | A1 | 6/2005 | Zhan et al. | |

(Continued)

FOREIGN PATENT DOCUMENTS

| | | |
|---|---|---|
| EP | 1051058 | 11/2000 |
| JP | S59139799 A | 8/1984 |

OTHER PUBLICATIONS

Extended European Search Report for EP16184069.9, dated Jan. 20, 2017 (with Machine Translation).

(Continued)

*Primary Examiner* — Andrew L Sniezek

(74) *Attorney, Agent, or Firm* — JK Intellectual Property Law, PA

(57) ABSTRACT

A MEMS loudspeaker for generating sound waves within an audible wavelength spectrum includes a circuit board, a membrane spaced from the circuit board and being deflectable along a z-axis, at least one piezoelectric actuator for deflecting the membrane, an electronic control unit embedded in the circuit board for controlling the at least one piezoelectric actuator, and at least one position sensor for providing to the control unit a sensor signal dependent on the deflection of the membrane, the control unit controlling the piezoelectric actuator based on the sensor signal.

20 Claims, 4 Drawing Sheets

(56) References Cited

U.S. PATENT DOCUMENTS

| | | | | |
|---|---|---|---|---|
| 2006/0129047 | A1 | 6/2006 | Ruotoistenmaki | |
| 2011/0051985 | A1 | 3/2011 | Hwang et al. | |
| 2011/0182150 | A1 | 7/2011 | Cohen et al. | |
| 2012/0087521 | A1 | 4/2012 | Delaus et al. | |
| 2014/0177881 | A1 | 6/2014 | Fanget et al. | |
| 2015/0071467 | A1 | 3/2015 | Kaplan et al. | |
| 2016/0305837 | A1* | 10/2016 | Froemel | G01L 9/0073 |
| 2017/0006386 | A1* | 1/2017 | Margalit | B81B 3/0021 |
| 2017/0041716 | A1* | 2/2017 | Barzen | H04R 19/005 |

OTHER PUBLICATIONS

Backman, Juah, "*Mobile Phone Audio: The Shape of Things to Come*", AES, 34th International Conference, Aug. 28-30, 2008.

German Search Report for German Application No. 10 2015 114 242.2, dated May 24, 2016.

* cited by examiner

MEMS LOUDSPEAKER WITH POSITION SENSOR

CROSS-REFERENCE TO RELATED APPLICATIONS

This application claims benefit to German Patent Application No. 10 2015 114 242.2, filed Aug. 27, 2015, which is incorporated in its entirety by reference herein.

TECHNICAL FIELD

The present disclosure relates to a Micro-Electromechanical Systems (MEMS) loudspeaker to generate sound waves within the audible wavelength spectrum. The MEMS loudspeaker has a circuit board, loud speaker, a membrane opposite the circuit board that can be deflected along a z-axis, at least one piezoelectric actuator for deflecting the membrane and an electronic control unit fully embedded in the circuit board to control the actuator, for example using an Application-Specific Integrated Circuit (ASIC).

BACKGROUND

MEMS systems are built into electronic devices that offer only little installation space. The performance of known MEMS loudspeakers depends largely on ideal environmental conditions. Even small shocks or other environmental influences can have deleterious effects on the system's performance. However, present requirements for such MEMS loudspeakers demand at least unchanging sound quality even when exposed to external influences.

The task of the present disclosure is therefore to provide a MEMS loudspeaker with improved performance.

SUMMARY

The task is solved by an MEMS loudspeaker having the characteristics of the present disclosure.

An MEMS loudspeaker for generating sound waves within the audible wavelength spectrum is disclosed. The MEMS loudspeaker has a circuit board, a membrane, at least one piezoelectric actuator, and one electronic control unit. The membrane can be deflected along a z-axis opposite the circuit board. The piezoelectric actuator deflects the membrane. The electronic control unit is fully embedded in the circuit board and controls the actuator, for example using an ASIC. The MEMS loudspeaker has at least one position sensor. With the position sensor, a sensor signal dependent on the membrane deflection can be provided to the control unit, which is designed to control the actuator in a regulated way based in the control signal.

To accomplish this, the membrane is deflected relative to the actuator and/or its position or deflection in z-direction recorded with the position sensor. The electronic input signal recorded by the position sensor is transmitted to the control unit, which determines the actual position or membrane's actual deflection via this input signal. Depending on this recorded actual position of the membrane, the control unit determines the membrane's desired target position and/or an electronic output signal dependent on it. The output signal is transmitted to the piezoelectric actuator, which deflects the membrane accordingly. During and/or at the end of the deflection movement, the real actual position of the membrane is recorded once again via the position sensor and, if need be, once more and/or iteratively readjusted or reset according to the preceding description. External influences and aging effects can be electronically compensated in this way.

An extreme deflection or a change of resonance frequency, for example caused by external influences, can be detected early and suppressed with the help of the position sensor. This lowers the risk of damaging the delicate mechanical and acoustic components, thereby preventing early wear. Service life is lengthened and reliability improved because the system can individually react to different influences. In known systems, for example, high-pass filters are necessary to generate maximum volume even with lower frequencies so components are not damaged. In the system according to the disclosure, the signal can be amplified in a way to compensate for interfering environmental conditions.

Through the regulated control of the actuator, based on the signal emitted by the position sensor, the system can diagnose itself. In this case, the functional capability of the MEMS loudspeaker, for example of its electromechanical components, can be determined without additional measures solely through deviations from defined standard values. The control unit can record shocks, powering-up problems or performance losses via of the sensor signal and react to them individually, for example through a regulated control of the actuator.

The regulated control of the actuator, resulting from a signal provided by the position sensor, can advantageously reduce MEMS loudspeaker distortions. The position sensor determines non-linear vibrations of the piezoelectric actuator and therefore of the membrane as well, so that the actuators deflection can be adjusted to environmental conditions to minimize harmonic distortion. Additionally, the MEMS loudspeaker can be adjusted to various environmental conditions such as external temperatures, pressure, humidity, etc.

It is advantageous for the control unit, the at least one piezoelectric actuator, and the at least one position sensor to form a closed loop. In this way, conditions caused by external influences (such as maximum deflection or change in resonance frequency) can be determined and suppressed, thereby preventing mechanical or acoustical components from being damaged. In addition, the functional capacity of the system's electrical and mechanical components can be easily checked by designing this closed loop.

To hinder the deflection as little as possible, it is advantageous if the piezoelectric actuator is executed as cantilever arm. Alternatively or additionally, it is advantageous if the position sensor is a piezoelectric, piezoresistive and/or capacitive sensor. The actuator structure can be excited in such a way through the control unit, for example the ASIC, that the membrane is made to vibrate to generate sound energy. Thereupon, the piezoelectric position sensor records the change of tension created as a result of the membrane's deflection, which is in turn evaluated by the control unit. In a piezoresistive position sensor, on the other hand, a change in the resistance is recorded, from which the control unit can infer the position of the membrane. A capacitive sensor, on the other hand, encompasses a fixed and a movable surface likewise deflected as a result of the membrane's excitation. The change in the separation of the two surfaces to each other also causes a change in capacity which is, in turn, recorded by the control unit. Depending on the design of the MEMS loudspeaker, a sensor ideal for the field of application can thereupon be selected.

In an advantageous further development of the disclosure, the position sensor is at least partially integrated into the actuator, for example the cantilever arm. In this way, the additional space needed by sensor and connecting elements can be kept as small as possible, so that only minimal losses of actuator performance are to be expected.

It is likewise also advantageous if the piezoelectric position sensor and the piezoelectric actuator are formed by a joint piezoelectric layer, which in this case is made of lead zirconate titanate (PZT). The tension generated by the piezoelectric effect can be transmitted to the control device for evaluation, so that the membrane's actual position can be easily determined.

It is advantageous if the joint piezoelectric layer has at least one sensor area and at least one actuator area. Here, the actuator area is insulated by the sensor area. Alternatively or additionally, the actuator area has a larger surface than the sensor area. In this way, different geometries can be designed to control the various areas and vibration modes as efficiently as possible.

It is likewise advantageous if the sensor area is arranged between two actuator areas and extends for example symmetrically and/or in longitudinal direction of the cantilever arm. Thus, the sensor system's geometry can be easily adapted to various requirements. This is done for example by having the sensor area separate the two actuator areas completely from one another. It is also conceivable to execute several sensor areas and arrange them in each case between two actuator areas. Alternatively or additionally, the sensor areas and the actuator area have the same length in the longitudinal direction of the bar to prevent accidental tilting.

In an advantageous further development of the disclosure, the piezoelectric position sensor is formed by a first piezoelectric layer. In this case, the use of the aluminum nitride (AlN) material has proven advantageous owing to its high thermal conductivity and electrical Insulation capability. Alternatively or additionally, the piezoelectric actuator is formed by a second piezoelectric layer, in which case this layer is made for example of PZT. Due to the high energy density, a required force-path product can be accomplished by a relatively small volume of the piezoactuator through PZT piezoceramic actuators. The two piezoelectric layers are preferably electrically insulated from one another. Alternatively or additionally, the first and second piezoelectric layers are arranged on top of each another with respect to the z-axis. The position sensor can thus be easily and inexpensively integrated during the course of the manufacturing process, for example layer by layer.

It is furthermore advantageous if the first piezoelectric layer is subdivided into several sensor areas. In this case, the sensor areas are separated from one another so the geometry of the position sensor can be inexpensively adapted to different applications. Alternatively or additionally, the sensor areas are electrically insulated, and alternatively or additionally, the second piezoelectric layer has one single actuator area. Alternatively or additionally, the full surface of the actuator area extends above the cantilever arm in a top view. The piezoelectric actuator can be economically and flexibly adapted to different areas and vibration modes.

Advantageously, three sensor areas are arranged separate from one another in cantilever arm direction. The separation of the sensor areas is equidistant in this case. By distributing the sensor areas uniformly, it is possible allows to control a large area and reliably compensate the determined external influences to ensure unchanging sound quality. Alternatively or additionally, the sensor areas have the same length compared with each other. Alternatively or additionally, the sensor areas have the same length in cantilever arm direction towards the actuator area.

It is advantageous if the piezoresistive position sensor is formed by at least one power line. Here, the power line extends preferably from a first to a second electrical contact point. The two electrical contacts are preferably arranged in the area of the firmly clamped end of the actuator. Advantageously, the power line has a U-shape design and, alternatively or additionally, it has a first longitudinal section. The first longitudinal section extends from the first electrical contact starting in cantilever arm direction and into the cantilever arm. Alternatively or additionally, the power line has a transversal section that extends in transversal direction of the cantilever arm. Alternatively or additionally, the power line has a second longitudinal section that extends, starting from the transversal section, in the longitudinal direction of the cantilever arm and out of it to the second electrical contact. In this way, an extremely sensitive bridge circuit can be executed for the precise determination of resistances or resistance changes. From the determined value, it is possible to infer the membrane's deflection so the control unit can control it in a regulated way.

In an advantageous further development, the power line is executed in a base layer of the piezoelectric actuator. The power line in the base layer can be formed by employing an ion implantation process. The base layer is preferably metallic. As a result of this, a conductive layer can be easily and inexpensively created. In addition, the actuators performance is positively influenced because the use of the piezoresistive position sensor furthermore forms a large actuator layer to excite the membrane.

Advantageously, the piezoresistive position sensor has several, for example four, power lines that have different electrical resistances compared to one another.

It is advantageous to execute the control unit as Wheatstone measuring bridge. To obtain the finest resolution possible in the measurement results, the power lines can alternatively or additionally also be executed as Wheatstone measuring bridge. As a result of that, a high useful signal can be provided that does not cause a hysteresis effect. The quality of the MEMS loudspeaker is therefore furthermore enhanced.

It is advantageous for the capacitive position sensor to encompass at least one recess and an extension movably arranged therein in z-direction. In this case, one of the two elements is arranged on the cantilever arm that can be deflected in z-direction and the other one on a stationary frame. Here, the recess forms a capacitive distance sensor and the extension an opposite surface movable to it, arranged on the cantilever arm. By deflecting the cantilever arm, the distance of the extension to the distance sensor increases, allowing the capacity to be determined in this way. From the determined capacity, the membrane's position (which depends on the deflection of the actuators structure) can also be easily determined.

To manufacture the capacitive position sensor economically, it is advantageous if at least one of the two internal surfaces of the recess is executed as a measuring electrode. Alternatively or additionally, the extension is executed as a dielectric or second measuring electrode, so that a capacitive sensor is formed that interacts with the first measuring electrode. By changing the board distance, the change in capacity can be determined and evaluated.

It is advantageous if the control unit is designed in such a way that the cantilever arm executed as piezoelectric actuator can be used either as actuator or position sensor. In this case, the cantilever arm is usable one moment as actuator and another moment as position sensor. The MEMS loudspeaker can therefore be inexpensively adapted to different conditions.

Preferably, the position sensor and the actuator are separated from one another. To hinder the deflection of a stroke structure as little as possible, the position sensor and the actuator are executed preferably by two individual cantilever arms.

Advantageously, the actuator is connected to the stroke structure of the MEMS loudspeaker movable in z-direction. Here, the connection takes place for example by means of a flexible connecting element. Alternatively or additionally, the position sensor is likewise connected to the stroke structure of the MEMS loudspeaker. It is advantageous if the membrane is attached to a front side of the stroke structure pointing in z-direction. Alternatively or additionally, the actuator and/or position sensor grasp sideways on the stroke structure. This takes place for example indirectly through the respective connecting element. The piezoelectric actuator is executed so it can induce a stroke movement in the stroke structure in order to deflect the membrane. By indirectly connecting the position sensor to the stroke structure, it is possible to reliably infer the membrane's position. In addition, this design allows the simultaneous transfer of strong forces and deflections to the membrane via the stroke structure.

It is advantageous if several actuators and/or position sensors are arranged symmetrically with regard to the center of gravity of the stroke structure. This is done for example in pairs and/or opposite it. This arrangement can prevent accidental tilting of the stroke body caused by an asymmetrical drive.

DESCRIPTION OF THE DRAWINGS

Further advantages of the disclosure are described in the following figures.

DETAILED DESCRIPTION

So the relationships among the various elements described below can be defined, relative terms used in the figure description such as above, below, up, down, over, under, left, right, vertical and horizontal, are used for the position of the objects in the corresponding figures. It goes without saying that if the position of the devices and/or elements shown in the figures changes, these terms can change. Therefore, if the orientation of the devices and/or elements shown with respect to the figures is inverted, for example, a characteristic in the subsequent figure description being specified as above can now be arranged below. Consequently, the relative terms used serve merely to facilitate the description of the relative relationships among the individual devices and/or elements described below.

Figure 1:
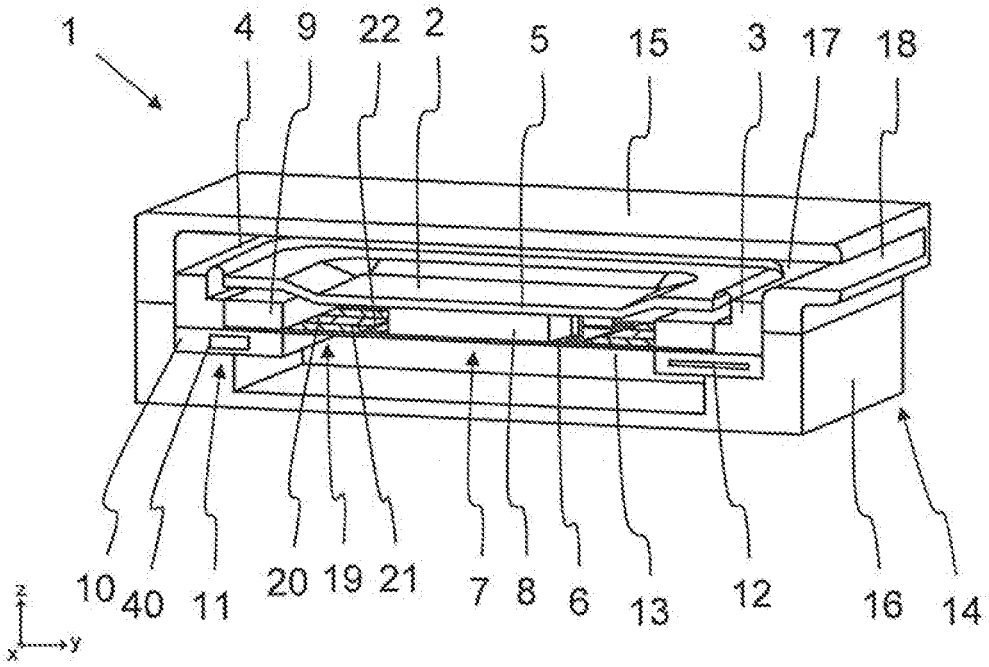
FIG. 1 is a perspective sectional view of an MEMS loudspeaker, according to an embodiment demonstrating certain aspects of the present disclosure.

FIG. 1 shows a first embodiment of an MEMS loudspeaker 1, configured to generate sound waves within the audible wavelength spectrum. To accomplish this, the MEMS loudspeaker 1 has a membrane 2 and a membrane carrier 3. In its edge area 4, the membrane 2 is connected to the membrane carrier 3 and is capable of vibrating along a z-axis with respect to the membrane carrier 3. In this case, the z-axis runs essentially perpendicularly to the membrane 2. An amplifying element 5 has been arranged on the underside of the membrane 2.

In addition to the membrane 2, the MEMS loudspeaker 1 has a stroke structure 6 coupled with the membrane 2, and at least one piezoelectric actuator 7. The actuator 7 is connected to the stroke structure 6 movable in z-direction via at least one coupling element 8. The membrane carrier 3 is arranged on a carrier substrate 9 of the piezoelectric actuator 7. This piezoelectric actuator 7 is arranged underneath the membrane 2 and/or essentially parallel to it. The piezoelectric actuator 7 is designed to induce a unidirectional or bidirectional stroke movement in the stroke structure 6 in order to deflect the membrane 2. It acts together with the membrane 2 to transform electrical signals to sound waves that can be acoustically perceived. The piezoelectric actuator 7 is arranged on a side of the carrier substrate 9 that faces away from the membrane 2.

Furthermore, the MEMS loudspeaker 1 encompasses a circuit board 10, in which an electronic control unit 11, for example an ASIC, has been fully embedded. In addition to the control unit 11, other passive components 12—such as electrical resistances and/or I/O contacts—can be embedded in the circuit board 10 and/or arranged on it. The MEMS loudspeaker 1 and for example the piezoelectric actuator 7 are connected to the control unit 11 with electrical contacts (not shown in the figures). Therefore, the MEMS loudspeaker 1 can be controlled or operated through the control unit 11, so that through the piezoelectric actuator 7, the membrane 2 is made to vibrate with respect to the membrane carrier 3, and generate sound energy. Here, the piezoelectric actuator 7 is executed as cantilever arm 13.

The MEMS loudspeaker 1 is arranged in a housing 14 that encompasses an upper housing section 15 and a lower housing section 16. The upper housing section 15 forms a sound guidance channel 17 with an acoustic inlet/outlet 18, arranged sideways on an outer surface of the MEMS loudspeaker 1. The housing 14, in particular, additionally protects the membrane 2, since it serves as environmental cover.

The MEMS loudspeaker 1 has at least one position sensor 19, executed to provide the electronic control unit 11 with a sensor signal that depends on the membrane deflection. The control unit 11 is executed to control the actuator 7 in a regulated way based on the sensor signal. For this purpose, the position sensor 19 can be a piezoelectric, a piezoresistive and/or a capacitive sensor. The position sensor 19 is at least partially integrated into the actuator 7, for example the cantilever arm 13.

In the embodiment shown, the position sensor 19 and the piezoelectric actuator 7 are formed by a joint piezoelectric layer 41. The piezoelectric layer is made of lead zirconate titanate (PZT). At least one area is a sensor area 20, through which two actuator areas 21 are arranged separate from one another. The sensor and actuator areas 20, 21 are electrically insulated from each other. Since the requirements for sensor systems and actuator systems can differ, a combination of various piezoelectric materials having different properties is also possible. In this case, the sensor area 20 can be executed from PZT and the actuator area 21 from aluminum nitride (AlN).

The sensor area 20 is arranged between the two actuator areas 21 and extends symmetrically in longitudinal direction of the cantilever arm. The actuator areas 21 are fully separated from one another by the sensor area 20. Both the sensor area 20 and the actuator area 21 have the same length in longitudinal direction of the cantilever arm. The surfaces of the two actuator areas 21 are larger than those of the sensor area 20.

When the membrane 2 deflects over the actuator 7, its position or deflection in z-direction is recorded by the position sensor 19. When this occurs, the tension generated by the piezoelectric effect—which is approximately proportional to the deflection of the stroke structure 6—is tapped and evaluated accordingly via the actuator electrodes. Via this recorded input signal, the control unit 11 determines the actual position or actual deflection of the membrane 2. While doing so, the elastic vibration properties of a connecting element 22 are considered. The connecting element 22 connects a free end of the position sensor 19 with the stroke structure 6. Depending on this recorded actual position of the membrane 2, the control unit 11 determines a desired target position of the membrane and/or an electronic output signal dependent on it. The output signal is transmitted to the actuator 7, which deflects the membrane 2 accordingly. During and/or at the end of the deflection movement, the real actual position of the membrane 2 is once again recorded via the position sensor 19 and, if need be, adjusted again to environmental conditions in accordance with the preceding description.

Figure 2:
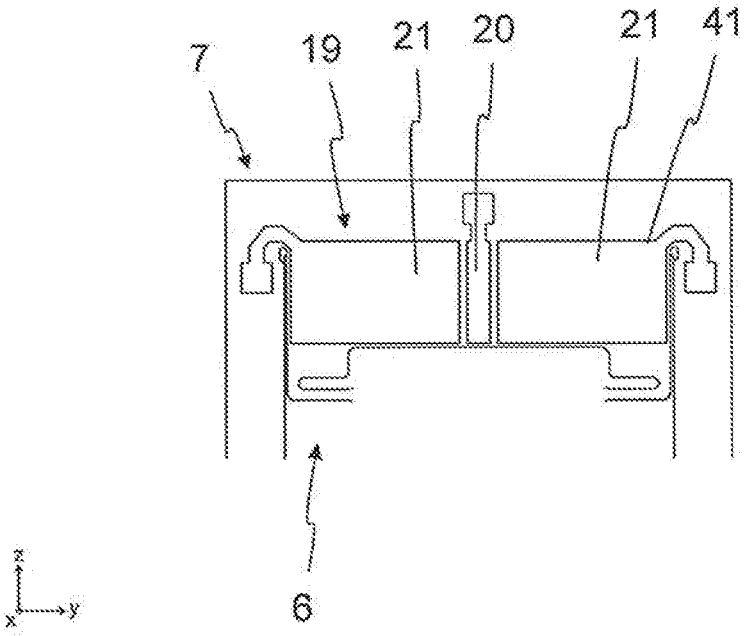
FIG. 2 is a schematic top view of an embodiment of a piezoelectric actuator with an integrated position sensor.

FIG. 2 shows a schematic top view of an embodiment of a piezoelectric actuator 7 with an integrated position sensor 19. Here, the piezoelectric actuator 7 has two actuator areas 21 separated from one another by the sensor area 20. Both areas 20, 21 are formed from PZT, but other piezoelectric materials could also be used. In this context, it could also be conceivable to use a large area for the actuator system and only a small area for the sensor. Here, the sensor area 20 is electrically insulated from the actuator areas 21. To prevent an accidental tilting of the stroke structure 6 due to an asymmetrical drive, the actuator and sensor areas 21, 20 should be arranged in pairs opposite each another.

Figure 3:
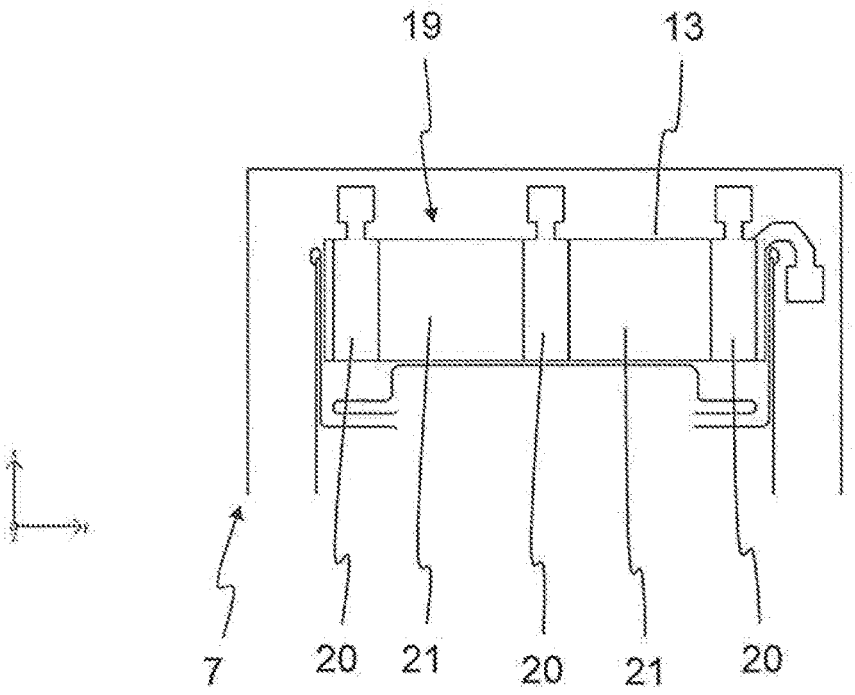
FIG. 3 is a schematic top view of a second embodiment of a piezoelectric actuator with an integrated position sensor.
Figure 4:
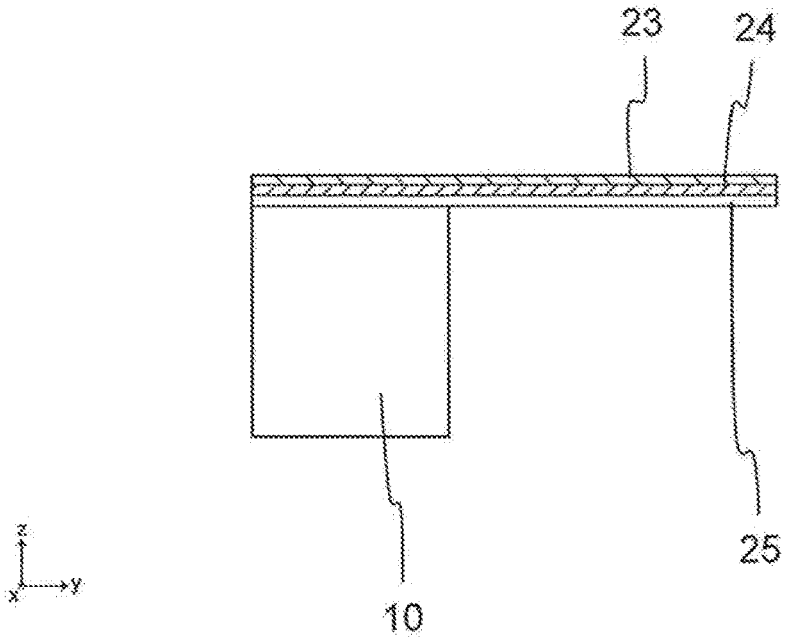
FIG. 4 is a schematic side view of the second embodiment of a piezoelectric actuator with an integrated position sensor.

FIGS. 3 & 4 show a schematic view of a second embodiment of the piezoelectric actuator 7 with position sensor 19. In this case, the piezoelectric position sensor 19 is formed by a first piezoelectric layer 23, for example made of AlN. The piezoelectric actuator 7 is formed by a second piezoelectric layer 24, made for example of PZT. The two layers are electrically insulated from one another and arranged on top of each other with respect to the z-axis. The first piezoelectric layer 23 is subdivided into several sensor areas 20. The sensor areas 20 are separated from one another and/or electrically insulated. In the embodiment shown, three sensor areas 20 have been created, arranged separate from each other in transversal direction of the cantilever arm. This can be formed for example in an equidistant way. The second piezoelectric layer 24 has an actuator area 21 extending above the cantilever arm 13. In a top view, the full surface of this actuator area 21 extends at least above the cantilever arm 13. In the longitudinal direction of the cantilever arm, both actuator areas 21 have the same length, but it is also conceivable for the sensor area 20 not to extend above the entire longitudinal direction of the cantilever arm, but only over a part of it. In this case, the difference to the length of the cantilever arm would be formed by another actuator area (not shown).

As shown in FIG. 4, the two piezoelectric layers 23, 24 form a stack supported by a base layer 25, which is connected to the circuit board 10. In the embodiment shown, the first piezoelectric layer 23 (which forms the position sensor 19) is arranged above the second piezoelectric layer 24, for example the actuator 7. However, the first piezoelectric layer 23 could also be arranged under the piezoelectric actuator 7.

Figure 5:
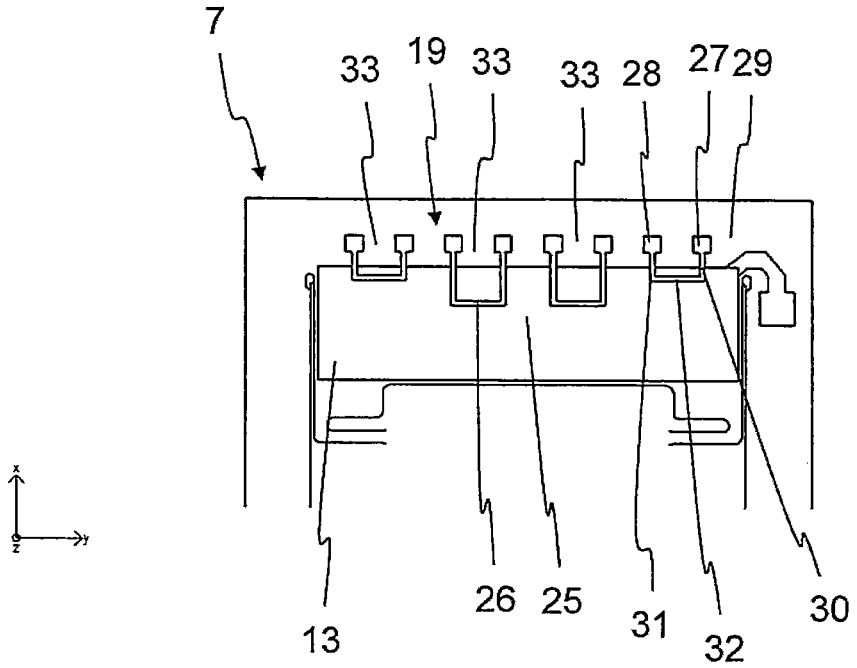
FIG. 5 is a schematic top view of a third embodiment of a piezoelectric actuator with a piezoresistive position sensor.

FIG. 5 shows a schematic top view of a third embodiment of a piezoelectric actuator 7 with an integrated position sensor 19. In this case, the position sensor 19 is executed in a piezoresistive way, for example through a power line 26. The power line 26 is formed by an ion implantation process in the base layer 25 of the piezoelectric actuator 7. The power line 26 extends from a first electrical contact 27 to a second electrical contact 28. The two electrical contacts 27, 28 are preferably arranged in the area of the firmly clamped end 29 of the actuator 7. The power line 26 is U-shaped and has a first longitudinal section 30 and a second longitudinal section 31. The first longitudinal section 30 extends from the first electrical contact 27 starting in longitudinal direction of the cantilever arm and into the cantilever arm 13. The second longitudinal section 31 extends from a transversal section 32 starting in longitudinal direction of the cantilever arm and out of the cantilever arm 13 to the second electrical contact 28, in which case the transversal section 32 extends in transversal direction of the cantilever arm. Four electrical resistances 33 are executed in the way just described. The resistances 33 differ from one another and are connected to the control unit 11 in such a way that a Wheatstone measuring bridge is formed.

The power lines 26, and also the resistances 33, react here to deformations resulting from the pressure change caused by the membrane deflection. The resistances 33 react to this with a change of resistance, which is recorded and evaluated by the control unit 11.

Figure 6:
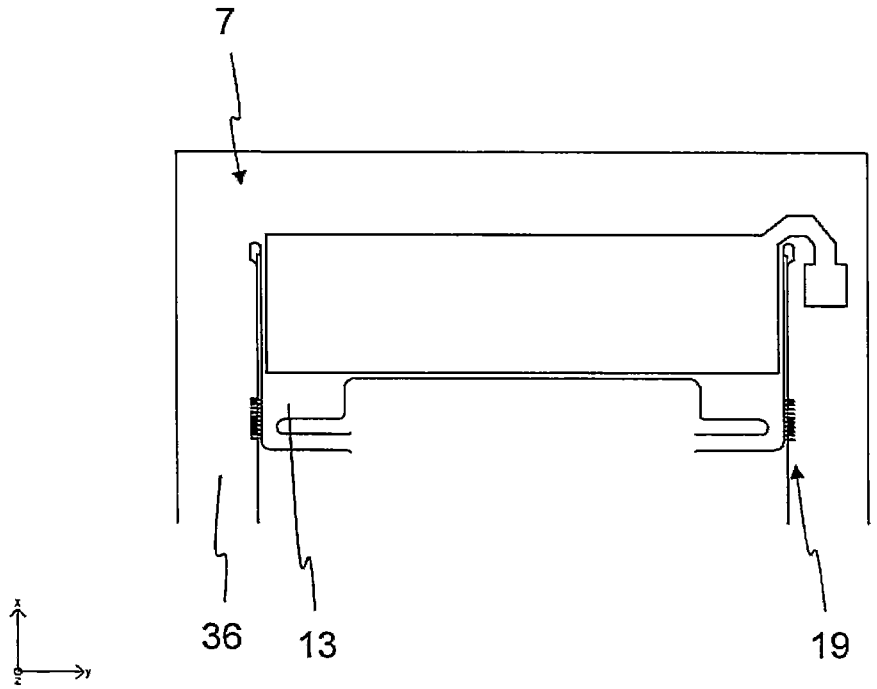
FIG. 6 is a schematic top view of a fourth embodiment of a piezoelectric actuator with a capacitive position sensor, and FIG. 7 an enlarged view of the capacitive position sensor.
Figure 7:
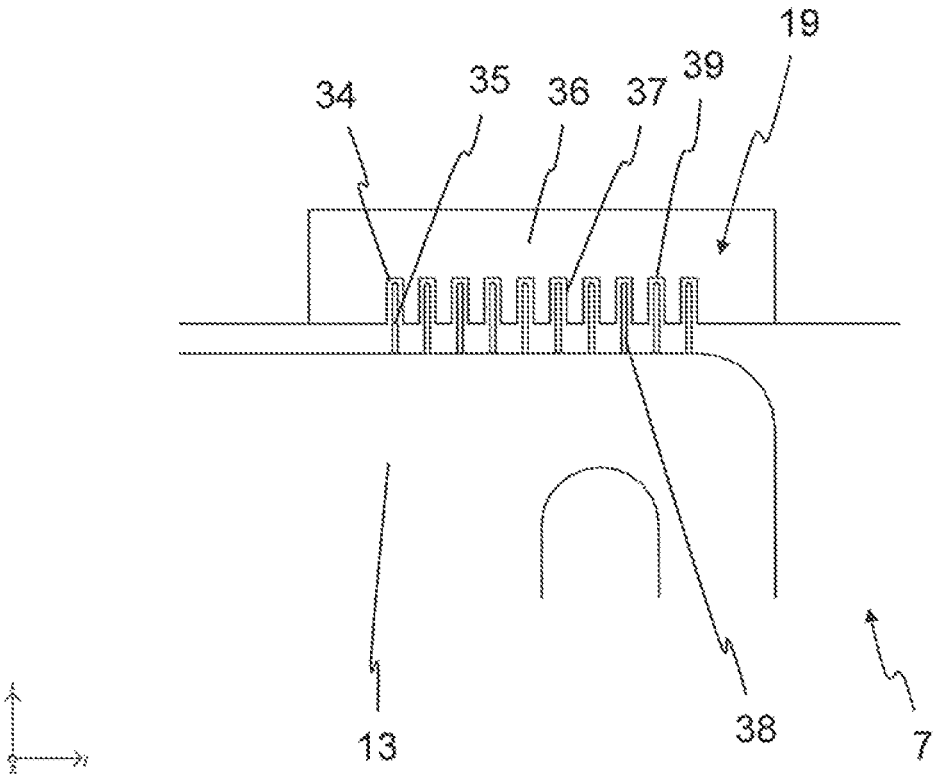

FIGS. 6 and 7 show a schematic top view and an enlarged view of a fourth embodiment of a piezoelectric actuator 7 with a capacitive position sensor 19. The capacitive position sensor 19 has several recesses 34, in each of which an extension 35 has been arranged. Every extension 35 is movable in z-direction. In the embodiment shown, the recesses 34 are arranged on a frame 36 and the extensions 35 on the cantilever arm 13. The cantilever arm 13 can also be deflected in z-direction. On the other hand, the frame 36 is stationary and preferably formed by the carrier substrate 9. However, it is also possible for the recesses 34 to be formed in the cantilever arm 13 and the extensions 35 on the frame 36. The recess 34 has two inner surfaces 37, wherein at least one of the inner surfaces 37 is executed as a first measuring electrode 38. The extension 35 is executed either as a second measuring electrode 39 or as a dielectric. An electrical condenser is executed in this way.

The excitation of the membrane 2 by the actuator 7 causes the extensions 35 on the cantilever arm 13 to deflect as well. The separation of the individual extensions 35 relative to the corresponding recess 34 becomes greater as a result of this. Consequently, the separation of the two measuring electrodes 38, 39, or the distance of the first measuring electrode 38 to the dielectric, becomes greater. Since the capacity is determined precisely by this separation, the control unit 11 records a change in capacity as a result of the deflection. Depending on this capacitive sensor signal, the actuator 7 can be controlled in a regulated way in order to excite the membrane 2 and adapt it to external influences (regarding this, see also FIG. 1).

The present disclosure is not restricted to the embodiments shown and described. Deviations within the framework of the patent claims are just as possible as a combination of the characteristics, even if they are shown and described in different embodiments.

The invention claimed is:

1. A MEMS loudspeaker for generating sound waves within an audible wavelength spectrum, the MEMS loudspeaker comprising:

a circuit board;

a membrane spaced from the circuit board, the membrane being deflectable along a z-axis;

at least one piezoelectric actuator for deflecting the membrane, the at least one piezoelectric actuator being configured as a cantilever arm;

an electronic control unit embedded in the circuit board for controlling the at least one piezoelectric actuator; and at least one position sensor for providing to the control unit a sensor signal dependent on the deflection of the membrane, the at least one position sensor being a piezoelectric position sensor that is at least partially integrated into the piezoelectric actuator in the form of a joint piezoelectric layer, the control unit controlling the piezoelectric actuator in a regulated way based on the sensor signal.

2. A MEMS loudspeaker according to claim 1, wherein the control unit, the at least one piezoelectric actuator, and the at least one position sensor form a closed loop.

3. A MEMS loudspeaker according to claim 1, wherein the joint piezoelectric layer has at least one sensor area and at least one actuator area electrically insulated from the at least one sensor area.

4. A MEMS loudspeaker according to claim 3, wherein the at least one sensor area extends in longitudinal direction of the cantilever arm, and is arranged between two of the actuator areas in such a way that the two actuator areas are fully separated from one another by the sensor area.

5. A MEMS loudspeaker according to claim 4, wherein the piezoelectric position sensor includes a first piezoelectric layer, and the piezoelectric actuator includes a second piezoelectric layer, the first and second piezoelectric layers being electrically insulated from each other.

6. A MEMS loudspeaker according to claim 5, wherein the first piezoelectric layer is subdivided into at least two sensor areas separated from and electrically insulated from one another, and the second piezoelectric layer has a single actuator area that extends fully over the cantilever arm.

7. A MEMS loudspeaker according to claim 6, wherein the sensor areas are separated from one another in a transverse direction of the cantilever arm.

8. A MEMS loudspeaker according to claim 7, wherein at least one of the control unit and the power line includes a Wheatstone measuring bridge.

9. A MEMS loudspeaker according to claim 1, wherein the position sensor is a capacitive position sensor, and the capacitive position sensor defines at least one recess and an extension movable therein in the z-axis direction, wherein one of the recess and the extension is arranged on the cantilever arm which is deflectable in z-axis direction, and the other of the recess and the extension is arranged on a stationary frame.

10. A MEMS loudspeaker according to claim 9, wherein the recess has two inner surfaces, and at least one of the two inner surfaces of the recess includes a measuring electrode and the extension is one of a dielectric or second measuring electrode.

11. A MEMS loudspeaker according to claim 1, wherein the control unit is configured so that the cantilever arm functions either as the piezoelectric actuator or as the position sensor.

12. A MEMS loudspeaker according to claim 1, wherein the position sensor and the piezoelectric actuator are separated from one another, wherein the cantilever arm of the piezoelectric actuator is a first cantilever arm, and wherein the position sensor includes a second cantilever arm.

13. A MEMS loudspeaker according to claim 1, wherein at least one of the piezoelectric actuator and the position sensor are connected to a stroke structure of the MEMS loudspeaker, the stroke structure being movable in a z-axis direction via at least one flexible connecting element.

14. A MEMS loudspeaker for generating sound waves within an audible wavelength spectrum, the MEMS loudspeaker comprising:

a circuit board;

a membrane spaced from the circuit board, the membrane being deflectable along a z-axis;

at least one piezoelectric actuator for deflecting the membrane the at least one piezoelectric actuator being configured as a cantilevered arm;

an electronic control unit embedded in the circuit board for controlling the at least one piezoelectric actuator; and at least one position sensor for providing to the control unit a sensor signal dependent on the deflection of the membrane, the control unit controlling the piezoelectric actuator in a regulated way based on the sensor signal, wherein the at least one position sensor is a piezoresistive position sensor, and the piezoresistive position sensor is formed by at least one power line that extends from a first electrical contact to a second electrical contact, wherein the first and second electrical contacts are arranged in a firmly clamped end of the piezoelectric actuator.

15. A MEMS loudspeaker according to claim 14, wherein the at least one power line is configured in a U-shape with a first longitudinal section that extends from the first electrical contact into the cantilever arm in a longitudinal direction of the cantilever arm, a transverse section that extends in a transverse direction of the cantilever arm, and a second longitudinal section that extends from the transverse section in a longitudinal direction of the cantilever arm out of the cantilever arm to the second electrical contact.

16. A MEMS loudspeaker according to claim 14, wherein the power line includes a metallic base layer of the piezoelectric actuator.

17. A MEMS loudspeaker according to claim 14, wherein the piezoresistive position sensor includes a plurality of the power lines, each power line having a respective electrical resistance that differs from the electrical resistance of the other power lines.

18. A MEMS loudspeaker for generating sound waves within an audible wavelength spectrum, the MEMS loudspeaker comprising:

a circuit board;

a membrane spaced from the circuit board, the membrane being deflectable along a z-axis;

at least one piezoelectric actuator for deflecting the membrane, the at least one piezoelectric actuator being configured as a cantilever arm;

an electronic control unit embedded in the circuit board for controlling the at least one piezoelectric actuator; and at least one position sensor for providing to the control unit a sensor signal dependent on the deflection of the membrane, the at least one position sensor being a piezoelectric position sensor including a first piezoelectric layer, and the piezoelectric actuator includes a second piezoelectric layer, the first and second piezoelectric layers being electrically insulated from each other, the control unit controlling the piezoelectric actuator in a regulated way based on the sensor signal.

19. A MEMS loudspeaker according to claim 18, wherein the first piezoelectric layer is subdivided into at least two sensor areas separated from and electrically insulated from one another, and the second piezoelectric layer has a single actuator area that extends fully over the cantilever arm.

20. A MEMS loudspeaker according to claim 19, wherein the sensor areas are separated from one another in a transverse direction of the cantilever arm.

* * * * *